US012043950B2

(12) United States Patent
Yoon et al.

(10) Patent No.: US 12,043,950 B2
(45) Date of Patent: Jul. 23, 2024

(54) LAUNDRY TREATMENT APPARATUS AND CONTROL METHOD THEREOF

(71) Applicant: LG ELECTRONICS INC., Seoul (KR)

(72) Inventors: Juhan Yoon, Seoul (KR); Ingeun Ahn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 662 days.

(21) Appl. No.: 17/330,820

(22) Filed: May 26, 2021

(65) Prior Publication Data

US 2021/0372032 A1 Dec. 2, 2021

(30) Foreign Application Priority Data

Jun. 1, 2020 (KR) ..... 10-2020-0065745

(51) Int. Cl.
*D06F 58/45* (2020.01)
*D06F 58/04* (2006.01)
(Continued)

(52) U.S. Cl.
CPC ..... *D06F 58/45* (2020.02); *D06F 58/04* (2013.01); *D06F 58/10* (2013.01); *D06F 58/206* (2013.01); *D06F 58/24* (2013.01)

(58) Field of Classification Search
CPC ..... D06F 58/45; D06F 58/04; D06F 58/10; D06F 58/206; D06F 58/24
(Continued)

(56) References Cited

U.S. PATENT DOCUMENTS 5,953,833 A * 9/1999 Rudd ..... F26B 13/14 34/535
6,088,932 A * 7/2000 Adamski ..... D06F 58/26 34/607
(Continued)

FOREIGN PATENT DOCUMENTS

CN 1886628 A 12/2006
CN 102124156 A 7/2011
(Continued)

OTHER PUBLICATIONS

Office Action in Chinese Appln. No. 202110598718.5, dated Mar. 23, 2023, 20 pages (with English translation).
(Continued)

*Primary Examiner* — Stephen M Gravini
(74) *Attorney, Agent, or Firm* — Fish & Richardson P.C.

(57) ABSTRACT

A laundry treatment apparatus includes: a cabinet, a drum rotatably disposed within the cabinet, a suction duct to which air discharged from the drum flows, a circulation flow path connected to the suction duct and configured to guide the air from the suction duct, an inflow duct connecting the circulation flow path to the drum such that the air received from the circulation flow path flows back to the drum through the inflow duct, a circulation fan configured guide the air between the suction duct and the inflow duct, a heat exchanger that is disposed at the circulation flow path and that is configured to perform heat exchange with the air, and an UV sterilizer disposed at a space that is defined in the circulation flow path at a position above a front surface of the heat exchanger, the sterilizer being configured to irradiate UV light to the heat exchanger.

20 Claims, 12 Drawing Sheets

(51) Int. Cl.
*D06F 58/10* (2006.01)
*D06F 58/20* (2006.01)
*D06F 58/24* (2006.01)

(58) Field of Classification Search
USPC ..... 34/282, 595–610
See application file for complete search history.

(56) References Cited

U.S. PATENT DOCUMENTS

| | | | | |
|---|---|---|---|---|
| 7,665,227 | B2 * | 2/2010 | Wright | D06F 25/00 34/350 |
| 7,921,578 | B2 * | 4/2011 | McAllister | D06F 35/00 34/597 |
| 8,387,274 | B2 * | 3/2013 | Ashrafzadeh | D06F 58/20 68/5 R |
| 8,549,770 | B2 * | 10/2013 | Bellinger | D06F 58/38 34/543 |
| 8,776,394 | B2 * | 7/2014 | Catauro | F04D 29/281 415/214.1 |
| 8,844,160 | B2 * | 9/2014 | Beihoff | D06F 58/203 34/409 |
| 8,875,416 | B2 * | 11/2014 | Anderson | D06F 58/04 34/607 |
| 11,697,902 | B2 * | 7/2023 | Leibman | D06F 58/04 34/603 |
| 2005/0066538 | A1 | 3/2005 | Goldberg et al. | |
| 2007/0163098 | A1 * | 7/2007 | Tomasi | D06F 58/203 28/100 |
| 2021/0372032 | A1 * | 12/2021 | Yoon | D06F 58/24 |

FOREIGN PATENT DOCUMENTS

| | | | | | |
|---|---|---|---|---|---|
| CN | 105625006 | A | | 6/2016 | |
| CN | 109082822 | A | * | 12/2018 | A61L 2/10 |
| CN | 110699935 | A | | 1/2020 | |
| CN | 113756073 | A | * | 12/2021 | D06F 58/04 |
| EP | 3190225 | | | 7/2017 | |
| EP | 3243954 | A1 | | 11/2017 | |
| EP | 3919669 | A4 | * | 12/2021 | D06F 58/02 |
| KR | 1020070053045 | | | 5/2007 | |
| KR | 101467494 | | | 12/2014 | |
| KR | 1020150120054 | | | 10/2015 | |
| KR | 20190012838 | A | | 2/2019 | |
| KR | 1020190012838 | | | 2/2019 | |
| KR | 1020190128464 | | | 11/2019 | |
| KR | 20210148645 | A | * | 12/2021 | |
| WO | WO2015063016 | A1 | | 5/2015 | |

OTHER PUBLICATIONS

Extended European Search Report in European Appln. No. 21174436.2, dated Oct. 22, 2021, 7 pages.

* cited by examiner

LAUNDRY TREATMENT APPARATUS AND CONTROL METHOD THEREOF

CROSS-REFERENCE TO RELATED APPLICATION

This present application claims the benefit of priority to Korean Patent Application No. 10-2020-0065745, entitled "LAUNDRY TREATMENT APPARATUS AND CONTROL METHOD THEREOF," filed on Jun. 1, 2020, in the Korean Intellectual Property Office, the entire disclosure of which is incorporated herein by reference.

FIELD

The present disclosure relates to a laundry treatment apparatus and a control method thereof and, more particularly, to a laundry treatment apparatus having a function of drying clothes or bedclothes using high-temperature dry air and a control method thereof.

BACKGROUND

A laundry treatment apparatus refers to an apparatus used at home or at a laundry, to wash or dry clothes or bedclothes, or to remove wrinkles and creases from the clothes or bedclothes. That is, the laundry treatment apparatus refers to all types of apparatuses for managing or processing clothes. The laundry treatment apparatus includes a washing machine, a drying machine, a washing-and-drying machine, and the like.

Among these, the drying machine is a machine configured to evaporate moisture in a target object such as clothes or bedclothes inserted into the drum (or tub) by supplying heated air to the target object.

As the moisture is evaporated from the target object, the air discharged from the drum may have a relatively high temperature and a relatively high humidity. The high-temperature and high-humidity air discharged from the drum flows to a circulation flow path, which is provided in the drying machine, and the moisture in the air is removed at the circulation flow path. Thereafter, the moisture-removed air is heated, and then flows back to the drum.

With regard to such a laundry treatment apparatus having the function of drying clothes or bedclothes, Korean Patent Application Publication No. 10-2019-0128464 (hereinafter referred to as "related art 1") discloses a laundry treatment apparatus.

Specifically, the laundry treatment apparatus of related art 1 includes: a drum for containing clothing; a circulation flow path for forming a path which allows air discharged from a front opening of the drum to be introduced into a rear opening of the drum after heat exchange; and a base cabinet disposed at a lower portion of the drum to provide a space where various components are mounted.

According to the laundry treatment apparatus of related art 1, the circulation flow path is implemented in a simple structure by optimizing the design of the circulation flow path and the layout of each component. However, the invention of related art 1 cannot appropriately deal with a situation in which the circulation flow path is contaminated due to mold or bacteria growing therein.

In particular, the humidity in the circulation flow path becomes relatively high in the process of heat exchange of the air, and a relatively large amount of foreign substances such as lint are introduced into the circulation flow path. Considering these characteristics of the circulation flow path, if such contamination is not appropriately prevented, the laundry treatment apparatus may be easily contaminated, which may lead to serious complaints from users.

In addition, Korean Patent Application Publication No. 10-2015-0120054 (hereinafter referred to as "related art 2") discloses a dryer for clothes.

Specifically, related art 2 discloses a lint filter assembly for removing lint from the air discharged from the drying drum, and a lint filter cleaning device for removing lint attached to the lint filter assembly.

However, related art 2 only considers preventing degradation of efficiency of the dryer for clothes by appropriately removing lint from a circulation flow path of the air, and does not consider dealing with a situation in which the circulation flow path is contaminated due to mold or bacteria growing therein.

As described above, existing laundry treatment apparatuses for drying clothes or bedclothes using high-temperature dry air have hygiene-related issues, and these issues should be properly overcome.

SUMMARY

The present disclosure is directed to providing a laundry treatment apparatus capable of resolving the hygiene-related issues, and a control method thereof.

Specifically, an aspect of the present disclosure is directed to providing a laundry treatment apparatus and a control method thereof characterized by preventing a hygiene-related problem from arising due to mold or bacteria growing in a circulation flow path for the air.

Another aspect of the present disclosure is directed to providing a laundry treatment apparatus and a control method thereof characterized in that a sterilization process for the circulation flow path and an air circulation process through the circulation flow path may be smoothly performed without interrupting each other and without functional degradation.

Yet another aspect of the present disclosure is directed to providing a laundry treatment apparatus and a control method thereof characterized in that a sterilization process for the circulation flow path may be performed in the most appropriate way according to the current state and situation of the laundry treatment apparatus.

Aspects of the present disclosure are not limited to what has been described above, and other aspects not mentioned above will be apparent from the following description to those skilled in the art to which the present disclosure pertains.

A laundry treatment apparatus and the control method thereof according to an aspect of the present disclosure are characterized in that a heat exchanger installed in a circulation flow path may be UV-sterilized such that growth of mold or bacteria in the circulation flow path is prevented. In detail, as UV light is irradiated to the heat exchanger from a UV sterilizer installed in the circulation flow path, the heat exchanger may be UV-sterilized.

Here, the laundry treatment apparatus and the control method thereof according to an aspect of the present disclosure are characterized in that the UV light may be irradiated from the UV sterilizer towards a front surface of an evaporator of the heat exchanger.

In addition, the laundry treatment apparatus and the control method thereof according to an aspect of the present disclosure are characterized in that the UV light may be irradiated from the UV sterilizer through an LED module.

In addition, the laundry treatment apparatus and the control method thereof according to an aspect of the present disclosure are characterized in that the UV sterilizer may be installed in such a way that direct collision between the air flowing through the circulation flow path and the UV sterilizer is minimized, so as to prevent degradation of a heat exchange function and a sterilization function. Specifically, the UV sterilizer may be installed at a depressed portion of a cover frame covering an upper surface of the circulation flow path, such that direct collision between the air flowing through the circulation flow path and the UV sterilizer is minimized.

In addition, the laundry treatment apparatus and the control method thereof according to an aspect of the present disclosure are characterized in that the front surface of the evaporator may be cleaned in the process of circulation of the air.

Here, the laundry treatment apparatus and the control method thereof according to an aspect of the present disclosure are characterized in that the UV sterilizer may be installed on a first inclined surface of the cover frame, and the front surface of the evaporator may be cleaned as cleaning water runs down to the front surface of the evaporator along a second inclined surface of the cover frame.

In addition, the laundry treatment apparatus and the control method thereof according to an aspect of the present disclosure are characterized in that operation of the UV sterilizer may be periodically started and stopped according to a predetermined duty ratio.

In addition, the laundry treatment apparatus and the control method thereof according to an aspect of the present disclosure are characterized in that the operation of the UV sterilizer may be controlled according to a current state and situation of the laundry treatment apparatus. Specifically, the laundry treatment apparatus may detect a current operation mode of the laundry treatment apparatus, and operate the UV sterilizer when the laundry treatment apparatus is switched to a predetermined operation mode.

In addition, the laundry treatment apparatus and the control method thereof according to an aspect of the present disclosure are characterized in that a current state of the drum may be detected through a sensor, and when the current state of the drum reaches a predetermined state, the UV sterilizer may be operated.

Here, the laundry treatment apparatus and the control method thereof according to an aspect of the present disclosure are characterized in that a water content percentage in the drum may be estimated through an electrode sensor, and when the water content percentage reaches a predetermined value, the UV sterilizer may be operated.

In addition, the laundry treatment apparatus and the control method thereof according to an aspect of the present disclosure are characterized in that the UV sterilizer may be operated when a predetermined time period has passed from a time point at which the laundry treatment apparatus was switched to a standby mode.

In addition, the laundry treatment apparatus and the control method thereof according to an aspect of the present disclosure are characterized in that the UV sterilizer may be operated when an operation signal is inputted by a user.

Technical solutions of the present disclosure are not limited to the above-mentioned technical solutions, and other technical solutions not mentioned above will be clearly understood by those skilled in the art from the following description.

Hereinafter, effects of the laundry treatment apparatus and the control method thereof according to the present disclosure will be described.

According to at least one of the embodiments of the present disclosure, the heat exchanger may be UV-sterilized as UV light is irradiated to the heat exchanger by the UV sterilizer installed in the circulation flow path. Accordingly, mold or bacteria may be prevented from growing in the heat exchanger in the circulation flow path.

In addition, according to at least one of the embodiments of the present disclosure, the UV light may be irradiated towards the front surface of the evaporator of the heat exchanger from the UV sterilizer. Accordingly, the front surface of the evaporator, which is a portion of the UV sterilizer which foreign substances such as lint contact first and which is easy to be contaminated as mold or bacteria grows due to a relatively low temperature, may be intensively sterilized.

In addition, according to at least one of the embodiments of the present disclosure, as the UV light is irradiated from the UV sterilizer through the LED module, the UV sterilizer may be formed in a relatively simple structure and in relatively diverse ways, and UV light of various wavelengths may be selectively combined and used.

In addition, according to at least one of the embodiments of the present disclosure, the UV sterilizer may be installed at a depressed portion in the cover frame covering the upper surface of the circulation flow path, such that direct collision between the air flowing through the circulation flow path and the UV sterilizer is minimized. Accordingly, a sterilization process for the circulation flow path and an air circulation process through the circulation flow path may be smoothly performed without interrupting each other.

In addition, according to at least one of the embodiments of the present disclosure, as the front surface of the evaporator is cleaned in the process of circulation of the air, foreign substances such as lint and the like may be prevented from accumulating in the heat exchanger, and thus functional degradation may be prevented.

In addition, according to at least one of the embodiments of the present disclosure, the UV sterilizer may be installed on the first inclined surface of the cover frame, and the front surface of the evaporator may be cleaned as the cleaning water runs down to the front surface of the evaporator along the second inclined surface of the cover frame. Accordingly, the UV sterilizer and a cleaning part may be spatially separated from each other, and thus the cleaning water may be prevented from being sprayed onto the UV sterilizer.

In addition, according to at least one of the embodiments of the present disclosure, the operation of the UV sterilizer may be periodically started and stopped according to a predetermined duty ratio. Accordingly, intermittent and repeated sterilization stimulation may be applied to mold or bacteria, and thus, the sterilization efficiency may be further improved.

In addition, according to at least one of the embodiments of the present disclosure, the current operation mode of the laundry treatment apparatus may be detected, and when the laundry treatment apparatus is switched to a predetermined operation mode, the UV sterilizer may be operated. Accordingly, the sterilization process may be performed only when it is determined that the laundry treatment apparatus currently requires the sterilization process while the laundry treatment apparatus is operated.

In addition, according to at least one of the embodiments of the present disclosure, the current state of the drum may be detected through the sensor, and when the current state of the drum reaches a predetermined state, the UV sterilizer may be operated. Accordingly, the sterilization process may be performed only after it is determined that the laundry treatment apparatus is in a state requiring the sterilization process.

In addition, according to at least one of the embodiments of the present disclosure, the water content percentage in the drum may be estimated through the electrode sensor, and when the water content percentage reaches a predetermined value, the UV sterilizer may be operated. Accordingly, the sterilization process may be performed only after a drying process of the laundry treatment apparatus is practically completed.

In addition, according to at least one of the embodiments of the present disclosure, the UV sterilizer may be operated when a predetermined time period has passed from a time point at which the laundry treatment apparatus was switched to the standby mode. Accordingly, the sterilization process may be periodically performed even when the laundry treatment apparatus is not used for a relatively long period of time.

In addition, according to at least one of the embodiments of the present disclosure, the UV sterilizer may be operated when an operation signal is inputted by a user. Accordingly, users may directly select the sterilization process and have the laundry treatment apparatus perform the sterilization process as they want.

Further scope of the applicability of the present disclosure will be apparent from the detailed description below. However, since various changes and modifications within the spirit and scope of the present disclosure can be clearly understood by those skilled in the art, it should be understood that the detailed description and specific exemplary embodiments such as preferable exemplary embodiments of the present disclosure are just given as examples.

BRIEF DESCRIPTION OF THE DRAWINGS

The foregoing and other aspects, features, and advantages of the invention, as well as the following detailed description of the embodiments, will be better understood when read in conjunction with the accompanying drawings. For the purpose of illustrating the present disclosure, there is shown in the drawings an exemplary embodiment, it being understood, however, that the present disclosure is not intended to be limited to the details shown because various modifications and structural changes may be made therein without departing from the spirit of the present disclosure and within the scope and range of equivalents of the claims. The use of the same reference numerals or symbols in different drawings indicates similar or identical items.

DETAILED DESCRIPTION

Figure 1:
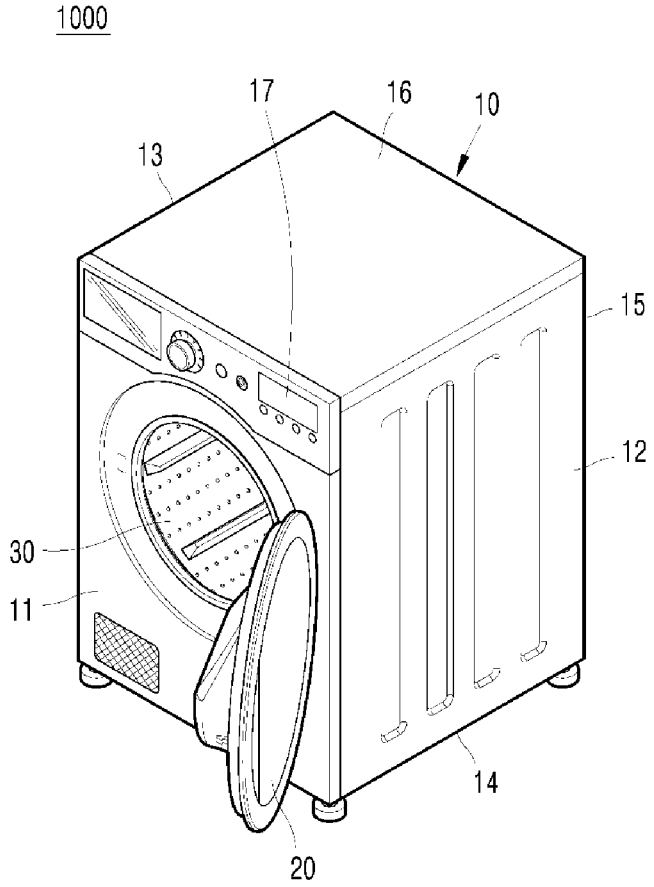
FIG. 1 is a perspective view of a laundry treatment apparatus according to an embodiment of the present disclosure.

Advantages and features of the present disclosure and methods for achieving them will become apparent from the descriptions of aspects herein below with reference to the accompanying drawings. However, the present disclosure is not limited to the aspects disclosed herein but may be implemented in various different forms. The aspects are provided to make the description of the present disclosure thorough and to fully convey the scope of the present disclosure to those skilled in the art. It is to be noted that the scope of the present disclosure is defined only by the claims.

The shapes, sizes, ratios, angles, the number of elements given in the drawings are merely exemplary, and thus, the present disclosure is not limited to the illustrated details. Like reference numerals designate like elements throughout the specification.

In relation to describing the present disclosure, when the detailed description of the relevant known technology is determined to unnecessarily obscure the gist of the present disclosure, the detailed description may be omitted.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms "first," "second," "third," etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

Hereinafter, preferable exemplary embodiments of the present disclosure will be described in detail referring to the attached drawings. However, description of known functions or configurations will be omitted in the following description in order to clarify the gist of the present disclosure.

Figure 2:
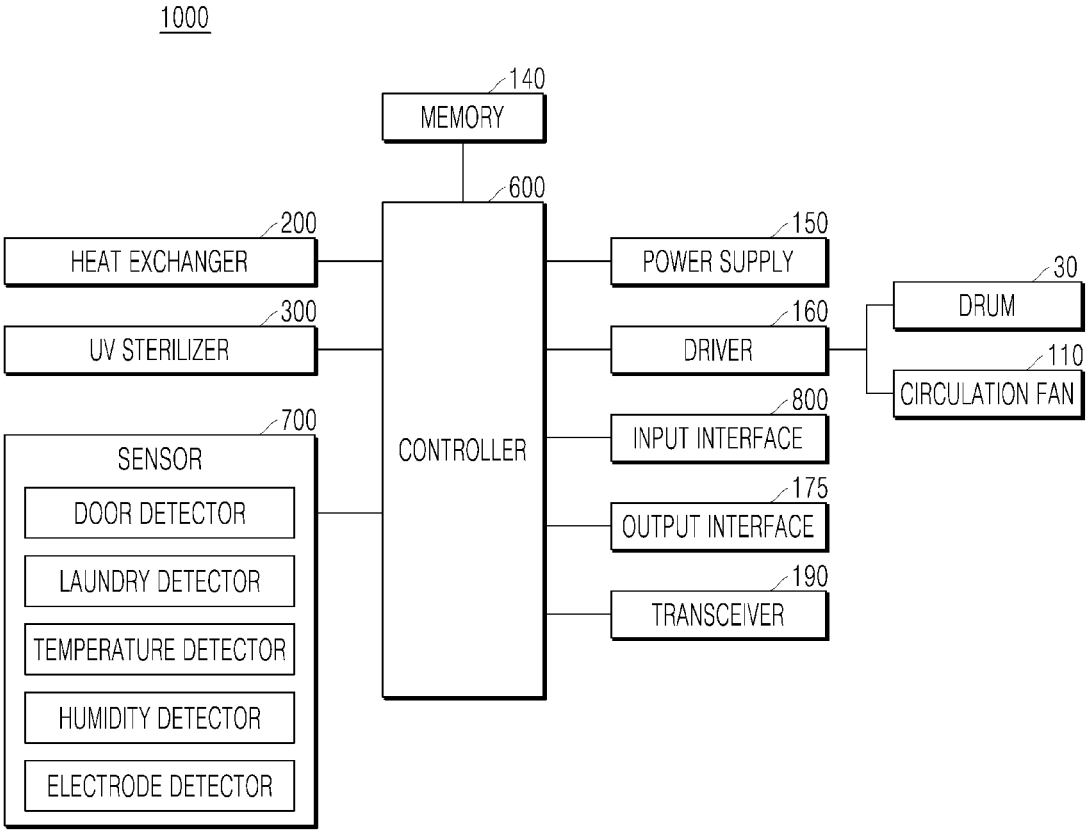
FIG. 2 is a diagram of main components of the laundry treatment apparatus according to an embodiment of the present disclosure.
Figure 3:
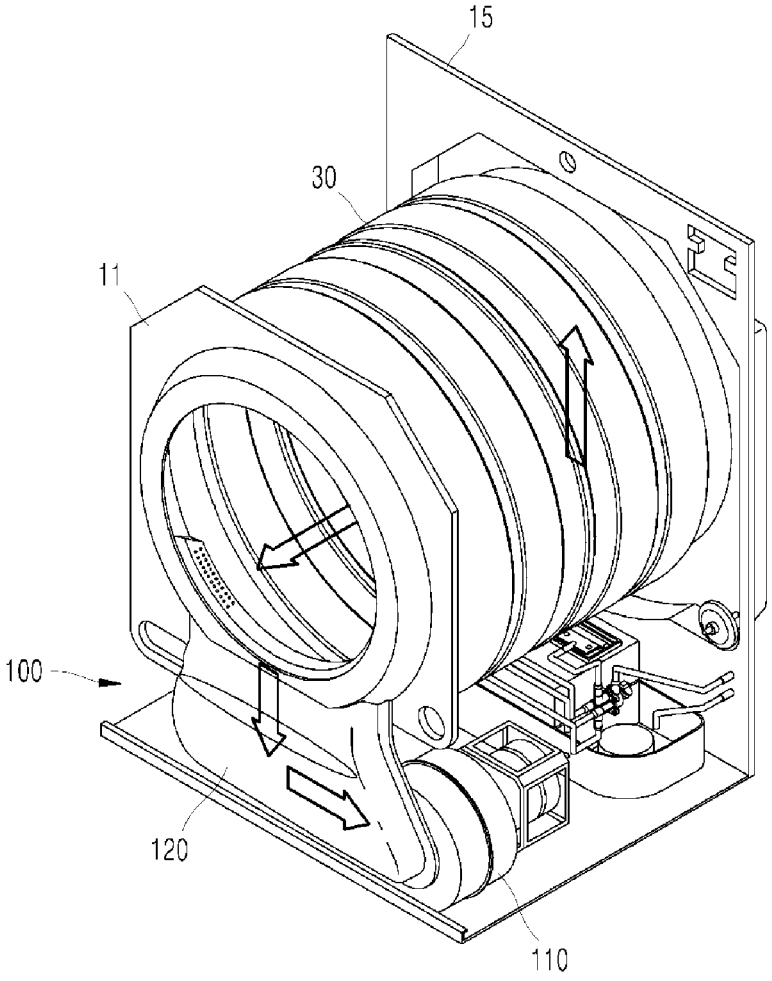
FIGS. 3 and 4 are views schematically illustrating circulation of air in the laundry treatment apparatus according to an embodiment of the present disclosure.
Figure 4:
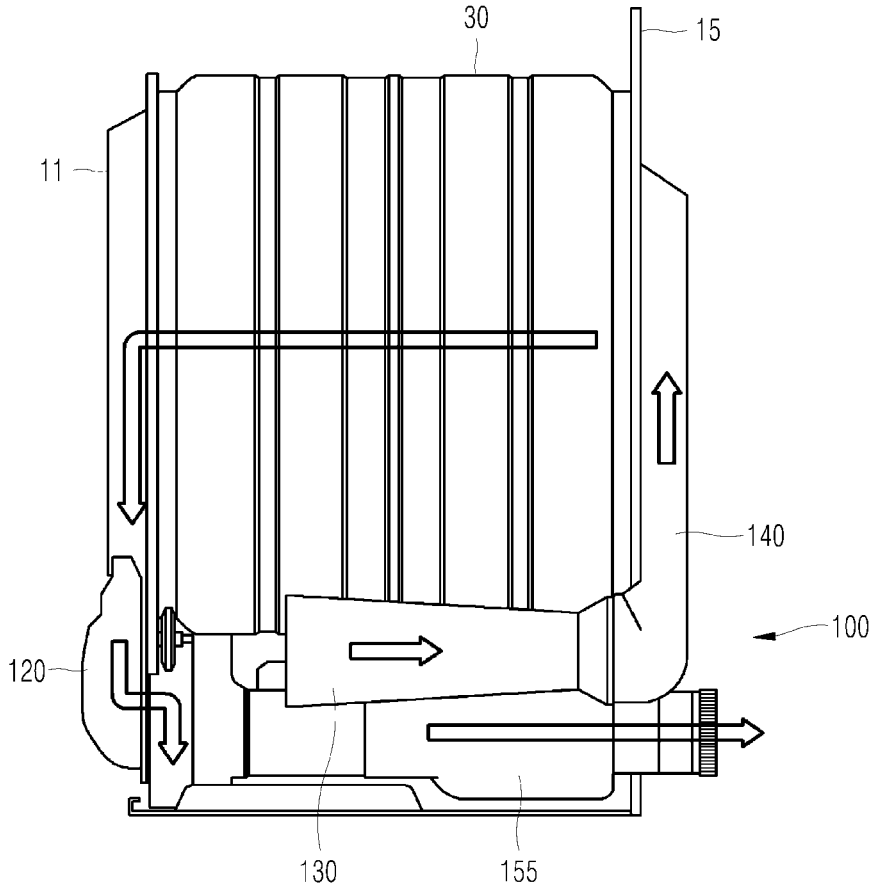

FIG. 1 is a perspective view of a laundry treatment apparatus according to an embodiment of the present disclosure. FIG. 2 is a diagram of main components of the laundry treatment apparatus according to an embodiment of the present disclosure. FIGS. 3 and 4 are views schematically illustrating circulation of air in the laundry treatment apparatus according to an embodiment of the present disclosure.

Hereinafter, a drying machine will be described as an example of the laundry treatment apparatus, but the laundry treatment apparatus of the present disclosure is not limited to the drying machine. The laundry treatment apparatus, as an apparatus configured to treat laundry (or an object to be dried) such as clothes inserted into the drum, may be a washing machine or a washing-and-drying machine.

Referring to FIGS. 1 to 4, a laundry treatment apparatus 1000 according to an embodiment of the present disclosure may include a cabinet 10, a drum 30 disposed inside the cabinet 10 and configured to be rotated with laundry (or fabric) received therein, a driver 160 configured to rotate the drum 30, a heat exchanger 200 configured to heat the air that is circulated from the drum 30 after drying the laundry, a circulation fan 110 configured to circulate the air in the drum 30, a suction duct 120 configured to suck the circulated air from the drum 30, and a circulation flow path 130 configured to guide a flow of the air.

The cabinet 10 may form an exterior of the laundry treatment apparatus 1000 and provide a space in which the drum 30 and other components are disposed. The cabinet 10 may be formed in the shape of a rectangular parallelepiped as a whole.

A door 20 may be disposed in a front surface of the cabinet 10, and may be rotated about a hinge provided at one side of the door 20 to open the cabinet 10. The cabinet 10 may include a front cover 11, a top plate 16, side covers 12 and 13, a rear cover 15, and a base 14.

A laundry loading hole may be formed in the front cover 11, and the door 20 may be provided in the front cover 11 to open and close the laundry loading hole. The laundry loading hole may communicate with the drum 30.

A control panel 17 may be disposed in an upper portion of the front cover 11. The control panel 17 may include a display (e.g., an LCD panel, an LED panel, etc.) on which a current operation state of the laundry treatment apparatus 1000 is displayed, an input interface 800 (e.g., a button, a dial, a touch screen, etc.) configured to receive an input of an operation command for the laundry treatment apparatus 1000 from a user, and an output interface 175 configured to output a voice guidance, a sound effect, or a warning sound for a current operation state.

The input interface 800 may include an input means installed in the control panel 17, such as at least one button, a switch, and a touch pad. The input interface 800 may receive inputs of operation settings, including an input for power on and off, an input for an operation mode, and an input for a laundry type setting. When a power-on signal is inputted and a type of laundry is selected, the input interface 800 may input data of the operation settings to a controller 600.

The output interface 175 may include a display on which information on the operation settings inputted by the input interface 800 is displayed and a current operation mode of the laundry treatment apparatus 1000 is outputted. In addition, the output interface 175 may include a speaker or a buzzer configured to output a voice guidance, or a predetermined sound effect or warning sound. The display may include a menu screen for setting and controlling operation of the laundry treatment apparatus 1000, and may output a message or a warning consisting of at least one of a letter, a number, or an image, about the operation settings and the current operation state of the laundry treatment apparatus 1000.

A memory 140 may store control data for controlling the operation of the laundry treatment apparatus 1000, data of inputted operation settings, data of an operation mode, and reference data for determining an error of the laundry treatment apparatus 1000. In addition, the memory 140 may store data that are detected or measured during an operation of the laundry treatment apparatus 1000 and data that are transmitted and received through a transceiver 190. The memory 140 may be a hardware storage device such as a ROM, a RAM, an EPROM, a flash drive, and a hard drive.

The transceiver 190 may transmit and receive data by wire or wirelessly. The transceiver 190 may transmit and receive data through a network formed within a building or within a predetermined distance, such as a home network. In addition, the transceiver 190 may be connected to an external server such as the Internet, and may communicate with a terminal having a control function.

The transceiver 190 may transmit a current operation state or a current drying state of the laundry treatment apparatus 1000, and receive a command for the laundry treatment apparatus 1000. The transceiver 190 may include a communication module, such as WiFi, WiBro, and the like, as well as through a near-field wireless communication module, such as Zigbee, Bluetooth, etc., so as to transmit and receive data.

A power supply 150 may convert supplied utility power and supply operation power. The power supply 150 may block overcurrent, and supply operation power of a predetermined amount by rectifying and smoothing the supplied power.

The drum 30 may be formed in a cylindrical shape, wherein a front surface and a back surface of the drum 30 may be open, and the front surface may communicate with the laundry loading hole. In addition, an inlet may be formed in the back surface of the drum 30 such that air can flow into the drum 30 through the inlet, and the inlet may be connected to an inflow duct 140 configured for air circulation. The inflow duct 140 may be connected to the circulation flow path 130.

The driver 160 may include a motor which is fixed to the base 14 of the cabinet 10. The motor may provide a driving force for rotating the drum 30, and may be connected to the circulation fan 110 to rotate the circulation fan 110. The air in the drum 30 may flow to the suction duct 120 due to the rotation of the circulation fan 110. The suction duct 120 may be connected to the circulation flow path 130.

When the circulation fan 110 rotates, the air may be circulated in such a manner that the air discharged from the drum 30 is guided to the suction duct 120, and then passes through the heat exchanger 200 via the circulation flow path 130, and then flows back to the drum 30 via the inflow duct 140.

The circulation flow path 130, which passes through the drum 30, may be formed in various forms. The circulation flow path 130 may be connected to the drum 30 to form a closed loop for air circulation. Here, the circulation flow path 130 may be formed in such a manner that some of the air is discharged to the outside through a discharge duct 155 as needed.

Figure 5:
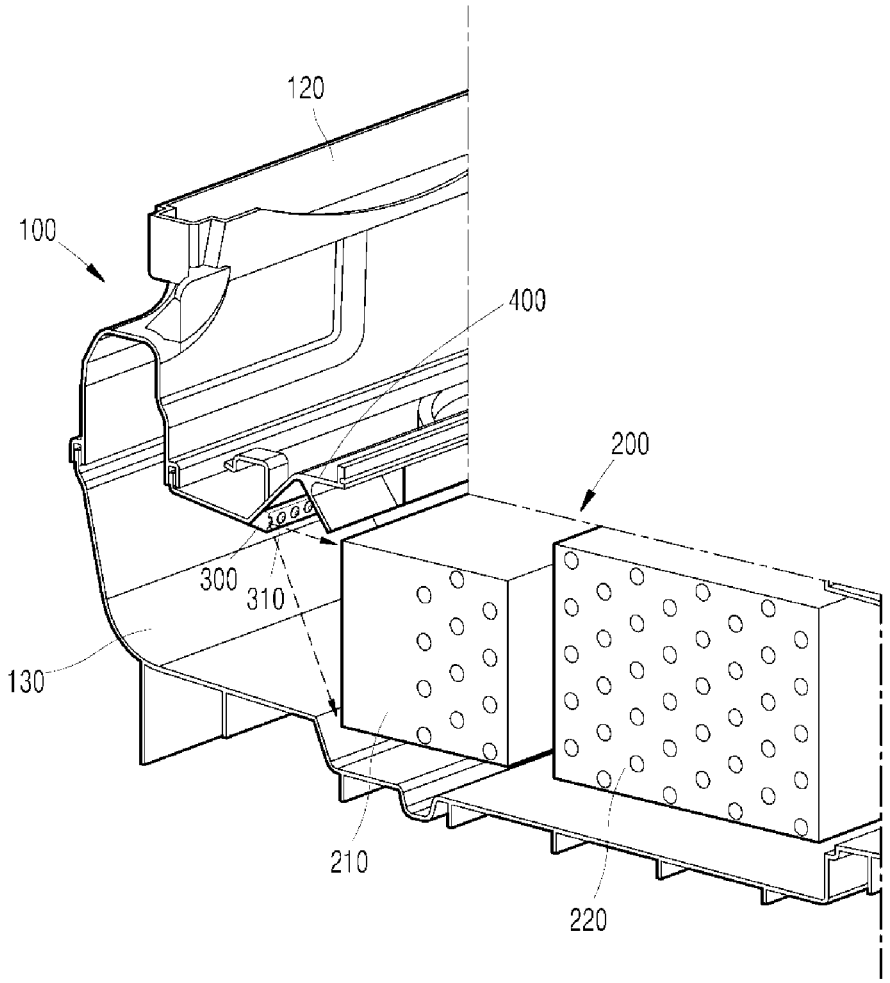
FIGS. 5 and 6 are views illustrating in more detail an air circulator, a heat exchanger, and a UV sterilizer of the laundry treatment apparatus according to an embodiment of the present disclosure.
Figure 6:
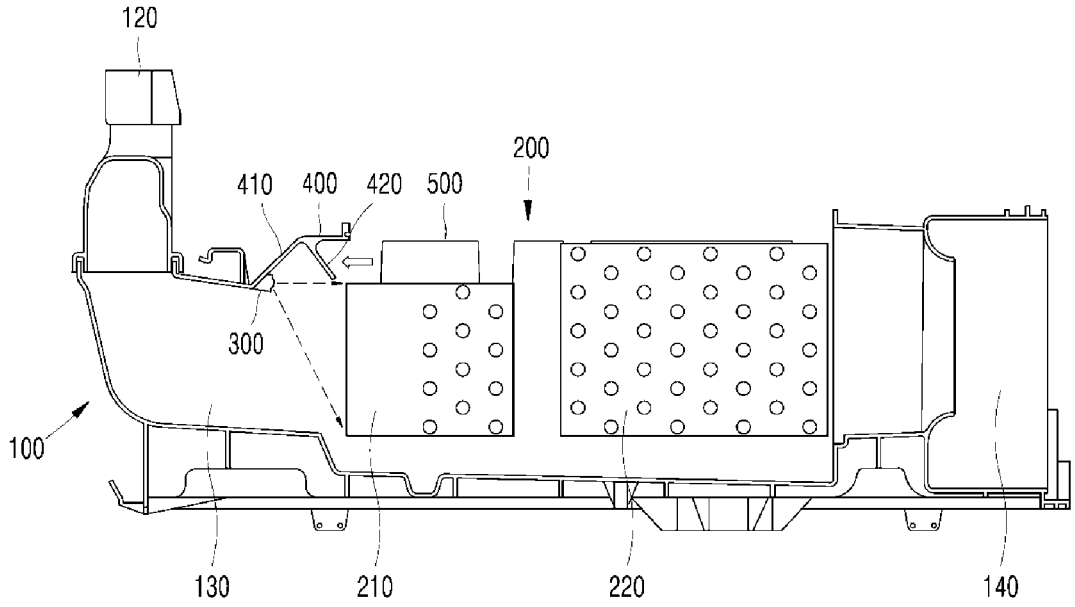

FIGS. 5 and 6 are views illustrating in more detail an air circulator, a heat exchanger, and a UV sterilizer of the laundry treatment apparatus according to an embodiment of the present disclosure.

As illustrated in FIGS. 5 and 6, the laundry treatment apparatus 1000 according to an embodiment of the present disclosure may include an air circulator 100, a heat exchanger 200, and a UV sterilizer 300.

The air circulator 100 is a component configured to guide the air discharged from the drum 30 to flow back to the drum 30, and may include the suction duct 120, the circulation flow path 130, the inflow duct 140, and the circulation fan 110, which were described in detail above.

The heat exchanger 200 is a component installed in the circulation flow path 130 of the air circulator 100 in order to perform heat exchange of the air, and may circulate a refrigerant such that a heat pump cycle is formed.

The laundry received in the drum 30 may be dried by heated air supplied to the drum 30. The air discharged from the drum 30, which contains moisture evaporated from the laundry in the drying process, may flow to the circulation flow path 130, be heated by the heat exchanger 200, and then be supplied back to the drum 30.

In detail, the heat exchanger 200 may include a compressor, an evaporator 210, a condenser 220, and an expansion valve. As the compressor, the evaporator 210, and the condenser 220 of the heat exchanger 200 are connected to a refrigerant pipe, the refrigerant may be circulated therethrough. In particular, the air that is heated as heat is exchanged between the air and the refrigerant in the condenser 220 and the evaporator 210 may be supplied to the drum 30. Here, the heat exchanger 200 may perform heat exchange of the air by using a medium other than the refrigerant, if necessary.

The evaporator 210 may absorb the heat of the air that passes through the circulation flow path 130 by exchanging heat between the refrigerant and the air that flows in the circulation flow path 130 via the suction duct 120 from the drum 30. In addition, the evaporator 210 may condense the moisture contained in the air passing through the circulation flow path 130.

In the condenser 220, heat exchange may occur between the refrigerant and the air that has passed through the evaporator 210, and the heated air may flow from the condenser 220 to the drum 30 via the inflow duct 140. In detail, the air that has passed through the evaporator 210 and thus has a relatively low temperature and a relatively low humidity may flow to the condenser 220, and when heat is exchanged between the refrigerant and the air in the condenser 220, the air may have a relatively high temperature and a relatively low humidity.

The refrigerant discharged from the condenser 220 may be recovered by the compressor after passing through the evaporator 210. The compressor may compress evaporated refrigerant and discharge the compressed refrigerant to the condenser 220. The expansion valve may expand, in the evaporator 210, the refrigerant that has been condensed in the condenser 220.

Since the air discharged from the drum 30 has a relatively high temperature and a relatively high humidity, and the temperature of the air is higher than a temperature of the refrigerant of the evaporator 210, when the air discharged from the drum 30 passes through the evaporator 210, heat is exchanged between the air and the refrigerant, and consequently, the air is condensed and cooled down. Accordingly, the air having the relatively high temperature and the relatively high humidity may be dehumidified and cooled down by the evaporator 210. Condensate water that is generated when the air is condensed may be collected by a condensate water housing, and may be discharged.

Meanwhile, in the heat exchange process described above, a large amount of moisture may come to be present in the circulation flow path 130, and in particular, the condensate water may be generated in the heat exchanger 200. That is, the circulation flow path 130 may always be in a high-humidity state. In addition, foreign substances such as a large amount of lint and the like may flow into the circulation flow path 130 from the drum 30, and the foreign substances may become attached to the heat exchanger 200.

Accordingly, the heat exchanger 200 may be contaminated by such foreign substances, and considering that the heat exchanger 200 is in a high-humidity, contaminated condition, it is highly likely that mold and bacteria will grow in the heat exchanger 200.

Accordingly, the laundry treatment apparatus 1000 according to the embodiment may be configured such that the heat exchanger 200, which is at risk of being contaminated, is UV-sterilized. For this, the UV sterilizer 300 may be installed in the circulation flow path 130 so as to irradiate UV light to the heat exchanger 200.

That is, UV light having a sterilization function may be irradiated from the UV sterilizer 300 towards the heat exchanger 200. Through this, the sterilization function may be carried out in the heat exchanger 200 by the UV light.

Here, the UV light is an invisible light with a wavelength shorter than a wavelength of visible light. Ultraviolet light with a wavelength between 200 nm and 300 nm or, in particular, ultraviolet light with a wavelength around 260 nm, may have a relatively strong sterilization function.

As described above, in the laundry treatment apparatus 1000 according to the embodiment, the heat exchanger 200 may be UV-sterilized as the UV sterilizer 300, which is installed in the circulation flow path 130, irradiates UV light to the heat exchanger 200. Accordingly, the heat exchanger 200 in the circulation flow path 130 may be prevented from being contaminated due to growth of mold or bacteria therein.

In the laundry treatment apparatus 1000 according to the embodiment, the heat exchanger 200 may include the evaporator 210 configured to remove moisture from the air passing through the circulation flow path 130, and a condenser 220 configured to heat the air that has passed through the evaporator 210, and the UV sterilizer 300 may irradiate UV light towards a front surface of the evaporator 210.

As illustrated in FIGS. 5 and 6, the air flowing in the circulation flow path 130 may contact the front surface of the evaporator 210 first. Considering that condensate water may be formed in a certain portion of a surface of the evaporator 210 due to the function thereof, it is highly likely that foreign substances such as lint in the air flowing to the circulation flow path 130 will become attached to the front surface of the evaporator 210.

In addition, considering that a temperature of the evaporator 210 is relatively low compared to temperatures of other parts of the heat exchanger 200 due to the function thereof, it can be said that the evaporator 210 is more likely to be contaminated by mold or bacteria compared to the other parts.

Accordingly, considering that contamination of the front surface of the evaporator 210 may be the most severe, it can be said that the front surface of the evaporator 210 requires an intense sterilization.

As described above, in the laundry treatment apparatus 1000 according to the embodiment, the UV sterilizer 300 may irradiate UV light towards the front surface of the evaporator 210 of the heat exchanger 200. Accordingly, the front surface of the evaporator 210, with which the lint or other foreign substances come into contact first and which is vulnerable to the growth of mold or bacteria due to the relatively low temperature, may be intensively sterilized.

In the laundry treatment apparatus 1000 according to the embodiment, the UV sterilizer 300 may include an LED module 310 configured to irradiate the UV light by using electric energy.

Here, the LED module 310 may include a package substrate made of a ceramic, a plurality of LED chips mounted on an upper surface of the package substrate, and a fluorescent substance applied so as to cover the LED chips.

In addition, a heat dissipation pad and an electrode pad may be formed in the LED module 310, wherein the heat dissipation pad and the electrode pad may be bonded to a bonding member and a circuit pattern in a printed circuit substrate, respectively, through a soldering process or the like.

In particular, compared to a UV lamp irradiating UV light, the LED module 310 may be variously designed in relatively simple structures. In addition, when the LED module 310 selectively combines and irradiates light of various wavelengths, various sterilization functions may be carried out according to the selectively combined wavelengths.

Furthermore, since light of an LED has a relatively narrow wavelength bandwidth, light of a specific wavelength may be irradiated by the LED module 310. Accordingly, harmful ultraviolet rays (UV) or unnecessary infrared rays (IR) may not be irradiated from the LED module 310, and thus the LED module 310 may have an advantage of relatively less side effects.

As described above, in the laundry treatment apparatus 1000 according to the embodiment, the UV sterilizer 300 may irradiate UV light through the LED module 310. Accordingly, the structure of the UV sterilizer 300 may be variously implemented in relatively simple structures. In addition, UV light of various wavelengths may be selectively combined and used.

Figure 7:
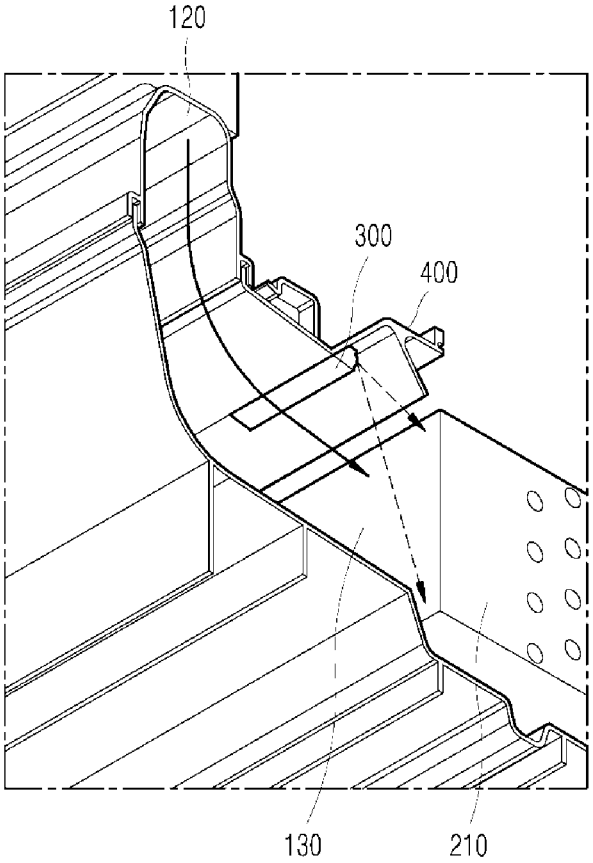
FIG. 7 is a view schematically illustrating a route of the air flowing through a circulation flow path of the laundry treatment apparatus according to an embodiment of the present disclosure.

FIG. 7 is a view schematically illustrating a route of the air flowing through the circulation flow path of the laundry treatment apparatus according to an embodiment of the present disclosure.

The laundry treatment apparatus 1000 according to an embodiment of the present disclosure may further include a cover frame 400 installed in a shape that covers an upper surface of the circulation flow path 130 and is depressed upwards from an upper portion of the front surface of the evaporator 210. The UV sterilizer 300 may be installed in a depressed portion of the cover frame 400.

That is, as illustrated in FIGS. 5 to 7, the upper surface of the circulation flow path 130 and, in particular, the upper portion of the front surface of the evaporator 210, may be covered by the cover frame 400. In other words, the cover frame 400 may be formed in such a shape that a portion thereof is depressed upwards, and the UV sterilizer 300 may be installed in the depressed portion of the cover frame 400.

Accordingly, as illustrated in FIG. 7, when the air flows through the circulation flow path 130, the flow of the air may not be disrupted by the UV sterilizer 300.

Consequently, as the flow of the air is not disrupted by the UV sterilizer 300 in the circulation flow path 130, the air may smoothly flow through the circulation flow path 130.

In addition, since the UV sterilizer 300 does not protrude into the flow path of the air in the circulation flow path 130, accumulation of foreign substances such as lint in the UV sterilizer 300 may be minimized.

If a large amount of foreign substances accumulates in the UV sterilizer 300, the amount of the UV light irradiated from the UV sterilizer 300 may be reduced, and as a result, the sterilization function may be impaired.

As described above, in the laundry treatment apparatus 1000 according to the embodiment, the UV sterilizer 300 may be installed in the depressed portion of the cover frame 400 which covers the upper surface of the circulation flow path 130, and thus direct collision of the air flowing through the circulation flow path 130 with the UV sterilizer 300 may be minimized. Accordingly, the sterilization process for the circulation flow path 130 and the air circulation process through the circulation flow path 130 may be smoothly carried out without interrupting each other.

Figure 8:
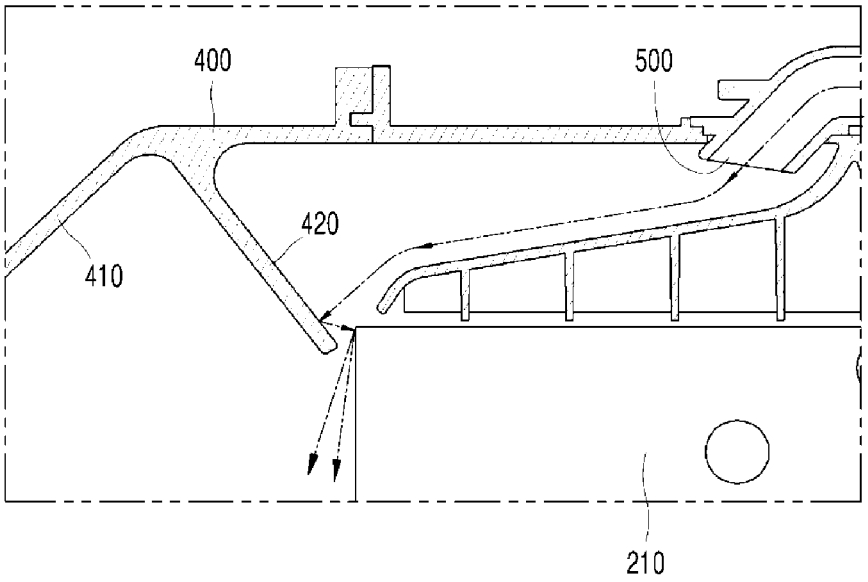
FIG. 8 is a view illustrating in more detail a cover frame and a cleaning part of the laundry treatment apparatus according to an embodiment of the present disclosure.

FIG. 8 is a view illustrating in more detail the cover frame and a cleaning part of the laundry treatment apparatus according to an embodiment of the present disclosure.

The laundry treatment apparatus 1000 according to an embodiment of the present disclosure may further include a cleaning part 500 configured to clean the front surface of the evaporator 210. That is, as illustrated in FIG. 8, cleaning water sprayed from the cleaning part 500 may clean the front surface of the evaporator 210.

As described above, a relatively large amount of foreign substances may become attached to the front surface of the evaporator 210. Accordingly, it is necessary to frequently clean the front surface of the evaporator 210 so as prevent the evaporator 210 from being degraded in terms of performance.

In the laundry treatment apparatus 1000 according to the embodiment, since the front surface of the evaporator 210 is cleaned in the process of the circulation of the air, functional degradation that may occur due to accumulation of foreign substances such as lint in the heat exchanger 200 may be prevented.

In the laundry treatment apparatus 1000 according to the embodiment, the cover frame 400 may include a first inclined surface 410 and a second inclined surface 420 which are coupled to each other and form a shape that is depressed upwards, wherein the UV sterilizer 300 may be installed in the first inclined surface 410, and the cleaning part 500 may spray the cleaning water onto the second inclined surface 420 such that the cleaning water runs down to the front surface of the evaporator 210 along the second inclined surface 420.

That is, as illustrated in FIG. 8, the depressed portion of the cover frame 400 may be formed of the first inclined surface 410 and the second inclined surface 420 which are coupled to each other to form a predetermined angle. In addition, the UV sterilizer 300 may be installed in the first inclined surface 410 and irradiate UV light towards the heat exchanger 200.

Meanwhile, it may be preferable that the cleaning water sprayed from the cleaning part 500 does not contact the UV sterilizer 300. Accordingly, a spraying path of the cleaning water is required to be spatially separated from the UV sterilizer 300.

By doing so, the cleaning water may be sprayed such that the cleaning water runs down to the front surface of the evaporator 210 along the second inclined surface 420 which is spaced apart from the UV sterilizer 300. That is, the cleaning water sprayed from the cleaning part 500 may collide with the second inclined surface 420 first and then run down to clean the front surface of the evaporator 210.

As described above, in the laundry treatment apparatus 1000 according to the embodiment, the UV sterilizer 300 may be installed in the first inclined surface 410 of the cover frame 400, and the cleaning part 500 may spray the cleaning water onto the second inclined surface 420 of the cover frame 400 such that the cleaning water runs down to the front surface of the evaporator 210 along the second inclined surface 420. Accordingly, the UV sterilizer 300 and the cleaning part 500 may be spatially separated from each other, and thus the cleaning water may be prevented from being sprayed onto the UV sterilizer 300.

Figure 9:
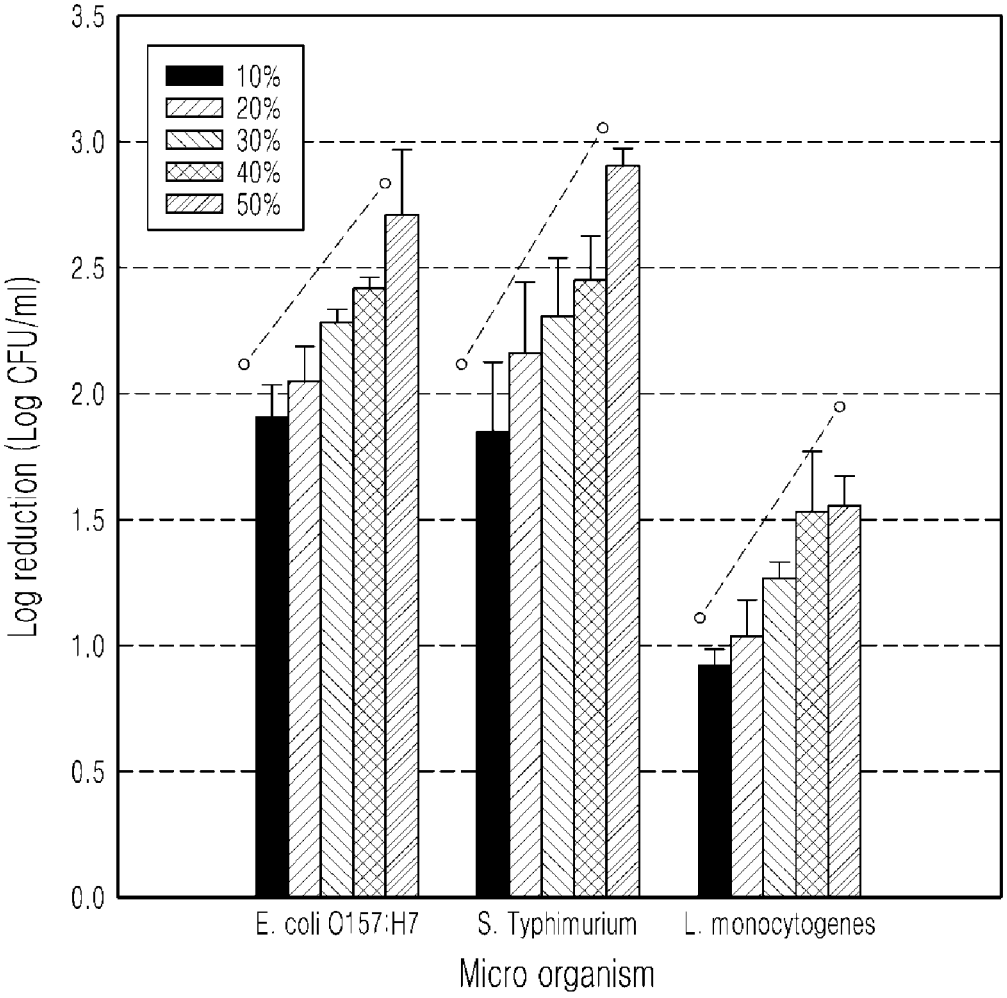
FIGS. 9 and 10 are exemplary views illustrating a correlation between a degree of sterilization and a duty ratio in the laundry treatment apparatus according to an embodiment of the present disclosure.
Figure 10:
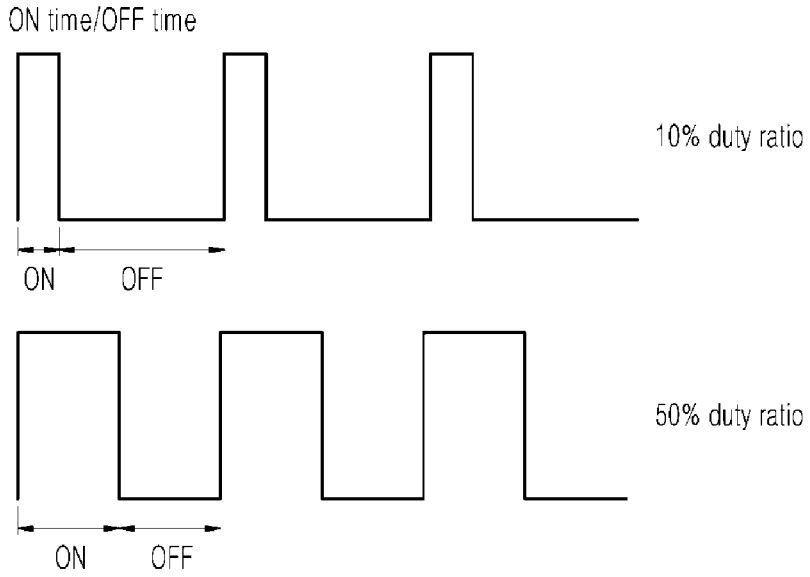

FIGS. 9 and 10 are exemplary views illustrating a correlation between a degree of sterilization and a duty ratio in the laundry treatment apparatus according to an embodiment of the present disclosure.

The laundry treatment apparatus 1000 according to an embodiment of the present disclosure may further include a controller 600 configured to control operation of the UV sterilizer 300, and the controller 600 may periodically start and stop the operation of the UV sterilizer 300 according to a predetermined duty ratio.

Here, the controller 600 may store, in the memory 140, an operation setting inputted from the input interface 800, process data transmitted from and received by the transceiver 190, and control the output interface 175 such that the operation setting and a current operation mode of the laundry treatment apparatus 1000 are outputted through the output interface 175. If there is a terminal in which an application for controlling the laundry treatment apparatus 1000 is installed and which is wirelessly connected to the laundry treatment apparatus 1000, the controller 600 may control the transceiver 190 such that data of the laundry treatment apparatus 1000 are transmitted to the terminal.

The controller 600 may control operations of the drum 30 and the circulation fan 110 through the driver 160 according to an operation setting inputted from the input interface 800, and may variably control the operations according to a sensing value of the sensor 700 which will be described below. The controller 600 may control the heat exchanger 200 such that the circulated air can be heated by the heat exchanger 200 during operation, and may control the temperature of the air supplied to the drum 30.

The controller 600 may control operation of the UV sterilizer 300. Here, the operation of the UV sterilizer 300 may include power on/off, operation time, and operation state of the UV sterilizer 300.

In particular, as illustrated in FIGS. 9 and 10, the controller 600 may adjust the duty ratio of the UV sterilizer 300 within a range from a minimum number to a maximum number of several tens. Here, the duty ratio means the proportion of on-sections to the total sections of a signal, and among the total sections, the UV light may be irradiated only in the on-sections.

When the UV sterilizer 300 does not continuously irradiate the UV light but periodically stops irradiating the UV light according to the predetermined duty ratio, the sterilization efficiency for mold and bacteria may be further improved.

For example, the LED module 310 may irradiate UV light in the form of a pulse according to a pulse width modulation (PWM) signal and the like. When the LED module 310 irradiates the UV light in the form of a pulse to the heat exchanger 200, light having a relatively high energy may be irradiated to the heat exchanger 200 for a relatively short period of time.

In addition, as the UV sterilizer 300 periodically stops irradiating the UV light, the mold or bacteria may be destroyed or damaged even by a relatively weak stimulation.

As described above, in the laundry treatment apparatus 1000 according to the embodiment, the UV sterilizer 300 does not continuously irradiate the UV light but may periodically stop irradiating the UV light according to the predetermined duty ratio. Accordingly, intermittent and repeated sterilization stimulation may be applied to the mold or bacteria, and thus, the sterilization efficiency may be further improved.

In the laundry treatment apparatus 1000 according to an embodiment of the present disclosure, the controller 600 may operate the UV sterilizer 300 when the laundry treatment apparatus 1000 is switched to a predetermined operation mode.

For example, when an operation mode in which steam is applied to the laundry in the drum 30 of the laundry treatment apparatus 1000 is in operation, the humidity of the air discharged from the drum 30 may be relatively high, and thus the efficiency of the irradiation of the UV light may be relatively low.

Accordingly, in order to improve the sterilization efficiency, the UV sterilizer 300 may be operated when a drying mode has started after the application of steam has ended in the laundry treatment apparatus 1000.

As described above, in the laundry treatment apparatus 1000 according to the embodiment, the controller 600 may detect the current operation mode of the laundry treatment apparatus 1000 and operate the UV sterilizer 300 when the laundry treatment apparatus 1000 has been switched to a predetermined operation mode. Accordingly, the sterilization process may be performed only when the laundry treatment apparatus 1000 is in a state requiring the sterilization process.

Figure 11:
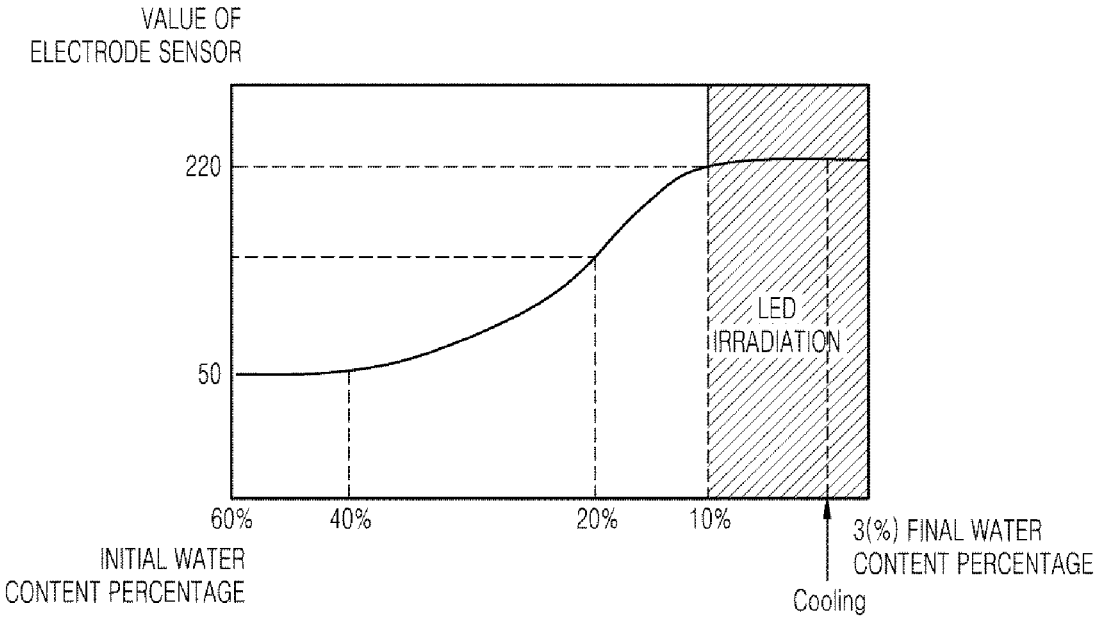
FIG. 11 is an exemplary view illustrating a correlation between a measured value of an electrode sensor and a water content percentage in the laundry treatment apparatus according to an embodiment of the present disclosure.

FIG. 11 is an exemplary view illustrating a correlation between a measured value of an electrode sensor and a water content percentage in the laundry treatment apparatus according to an embodiment of the present disclosure.

The laundry treatment apparatus 1000 according to an embodiment of the present disclosure may further include the sensor 700 installed so as to detect a current state of the drum 30, and the controller 600 may operate the UV sterilizer 300 according to the current state of the drum 30 detected by the sensor 700.

Here, the sensor 700 may include a plurality of sensors to measure a voltage or current of the laundry treatment apparatus 1000, detect a rotation speed of a motor, a temperature, and a humidity, and input the measured and detected values to the controller 600.

The sensor 700 may include a door detector, a laundry detector, a temperature detector, a humidity detector, and an electrode detector. The sensor 700 may further include a pressure sensor configured to detect a pressure of a refrigerant of the heat exchanger 200, a temperature sensor, and a speed detector configured to detect a rotation speed of the motor of the driver or a rotation speed of the drum 30.

Accordingly, through the sensor 700, it may be checked whether the laundry treatment apparatus 1000 is currently in a state requiring a sterilization process. For example, when the sensor 700 detects the temperature or humidity in the drum 30, and it is determined that the laundry treatment apparatus 1000 currently requires the sterilization process, the controller 600 may control the UV sterilizer 300 such that the UV sterilizer 300 is operated.

As described above, in the laundry treatment apparatus 1000 according to the embodiment, the UV sterilizer 300 may be operated only when the current state of the drum 30 detected by the sensor 700 reaches a predetermined state. Accordingly, the sterilization process may be performed only when it is determined that the laundry treatment apparatus 1000 currently requires the sterilization process.

In the laundry treatment apparatus 1000 according to an embodiment of the present disclosure, the sensor 700 may include an electrode sensor (which is the electrode detector in FIG. 2) installed in the drum 30, and when a water content percentage in the drum 30 that is estimated from a measured value of the electrode sensor reaches a predetermined value, the controller 600 may operate the UV sterilizer 300.

Specifically, the electrode sensor configured to detect a current state of the laundry in the drum 30 may be installed in the drum 30. The electrode sensor may be provided as two electrode sensors including an anode and a cathode spaced apart from each other by a certain distance, and the two electrode sensors may be installed so as to be exposed to the drum 30.

The electrode sensors may come into contact with the laundry in the drum 30 while the drum 30 is rotating, and accordingly, the electrode sensors may detect the current state of the laundry and, in particular, water content in the laundry (i.e., the water content percentage). According to the water content percentage detected by the electrode sensors, the controller 600 may determine whether the laundry is in a dry state.

When the laundry contacts the electrode sensors, the anode and the cathode may be brought into conduction by the moisture contained in the laundry, thus forming a closed circuit, and a value of current that flows in the circuit may vary depending on the amount of moisture contained in the laundry. Therefore, the degree of dryness of the laundry may be determined on the basis of the value of current. The value of current flowing in the circuit may also vary, since the laundry may act as a resistance against an electrode, and a value of the resistance may vary depending on the amount of moisture contained in the laundry.

As described above, the water content percentage in the drum 30 may be estimated through the electrode sensors, and when an estimated water content percentage reaches a predetermined value (for example, 10% in FIG. 11), it may be determined that the laundry is currently in a dry state in which it is appropriate to perform the sterilization process.

Accordingly, only when the water content percentage estimated through the electrode sensors reaches a predetermined value, the UV sterilizer 300 may be operated to perform the sterilization process.

As described above, in the laundry treatment apparatus 1000 according to the embodiment, the UV sterilizer 300 may be operated when the water content percentage estimated through the electrode sensors reaches a predetermined value. Accordingly, the sterilization process may be performed after a drying process has been practically completed in the laundry treatment apparatus 1000.

In the laundry treatment apparatus 1000 according to an embodiment of the present disclosure, the controller 600 may operate the UV sterilizer 300 when a predetermined time period has passed after a time point at which the laundry treatment apparatus 1000 was switched to a standby mode.

As described in detail above, when the laundry treatment apparatus 1000 is switched to a predetermined operation mode, or the drum 30 is in a predetermined state, the UV sterilizer 300 may be operated to perform the sterilization process.

However, when the laundry treatment apparatus 1000 is not used for a long period of time, the laundry treatment apparatus 1000 cannot be switched to a predetermined operation mode and the drum 30 cannot reach a predetermined state to thereby operate the UV sterilizer 300, and thus mold or bacteria may grow in the circulation flow path 130.

Accordingly, even when the laundry treatment apparatus 1000 is not used for a long period of time, the laundry treatment apparatus 1000 may be set in such a way that the sterilization process is automatically performed for the heat exchanger 200 when a predetermined time period has passed.

As described above, in the laundry treatment apparatus 1000 according to the embodiment, the UV sterilizer 300 may be operated when a predetermined time period has passed after a time point at which the laundry treatment apparatus 1000 was switched to the standby mode. Accordingly, the sterilization process may be periodically performed even when the laundry treatment apparatus 1000 is not used for a relatively long period of time.

Meanwhile, all of the predetermined duty ratio, the predetermined operation mode, the predetermined value, and the predetermined time period may be factors which are appropriately determined on the basis of experiments conducted in advance or statistical data, and may be variously set in a design stage of the laundry treatment apparatus 1000 or may be set by the user while the laundry treatment apparatus 1000 is used.

The laundry treatment apparatus 1000 according to an embodiment of the present disclosure may further include the input interface 800 to which an operation signal is inputted by the user, and the controller 600 may operate the UV sterilizer 300 when the operation signal is inputted to the input interface 800.

As described in detail above, the UV sterilizer 300 may be automatically operated when the laundry treatment apparatus 1000 is switched to a predetermined operation mode or the drum 30 is in a predetermined state. In addition, there is a possibility that the user may want to perform the sterilization process right away.

Considering that different users may have different sensitivities to the degree of contamination depending on his or her personality, it is anticipated that the frequency of performing the sterilization process may be different for each different user.

Accordingly, a user who wants to directly manipulate the laundry treatment apparatus 1000 to perform the sterilization process may input a signal to the input interface 800 for operating the UV sterilizer 300.

As described above, in the laundry treatment apparatus 1000 according to the embodiment, a user may be able to directly input an operation signal to the input interface 800 in order to operate the UV sterilizer 300. Accordingly, different users may directly operate the laundry treatment apparatus 1000 in different ways to operate the UV sterilizer 300.

Figure 12:
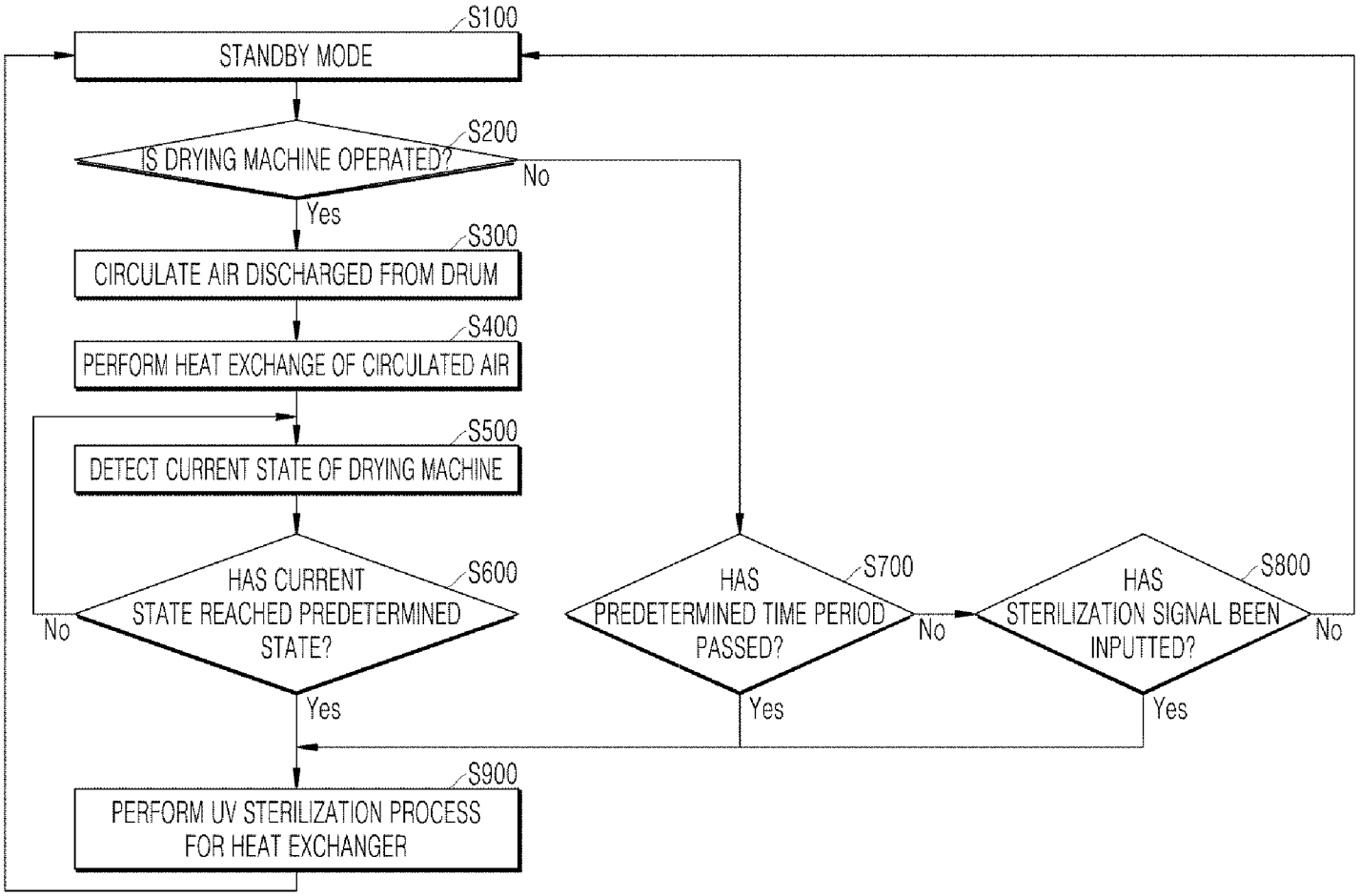
FIG. 12 is a flow chart illustrating a control method of the laundry treatment apparatus according to an embodiment of the present disclosure.

FIG. 12 is a flow chart illustrating a control method of the laundry treatment apparatus according to an embodiment of the present disclosure. Here, the control method of the laundry treatment apparatus according to the embodiment may include the main components of the laundry treatment apparatus 1000 described in detail above. Therefore, FIG. 12 will be described referring to FIGS. 1 to 11 together.

Firstly, the laundry treatment apparatus 1000 may be switched from the standby mode (S100) to an operation mode (S200) by an input of, for example, a predetermined operation signal.

Next, while the laundry treatment apparatus 1000 is in operation, the air may be circulated in such a way that the air discharged from the drum 30 is guided to flow back to the drum 30 (S300). Here, the air may be circulated through the suction duct 120, the circulation flow path 130, the inflow duct 140, and the circulation fan 110.

Next, while the air is circulated, heat of the air may be exchanged by the heat exchanger 200 installed in the circulation flow path 130 (S400). That is, the air discharged from the drum 30, which contains moisture evaporated from the laundry in the drying process, may flow to the circulation flow path 130, may be heated through the heat exchanger 200, and then may be supplied back to the drum 30.

Then, the UV sterilizer 300 may be controlled so as to irradiate UV light to the heat exchanger 200 (S500, S600, S700, S800, and S900). That is, the heat exchanger 200, which is at risk of being contaminated by mold or bacteria, may be UV-sterilized. For this, the UV sterilizer 300 may be installed in the circulation flow path 130 so as to irradiate the UV light to the heat exchanger 200.

The UV sterilizer 300 may be controlled in various ways depending on the current operation mode of the laundry treatment apparatus 1000 or the current state of the drum 30.

In the control method of the laundry treatment apparatus 1000 according to an embodiment of the present disclosure, the operation of the UV sterilizer 300 may be periodically started and stopped according to a predetermined duty ratio in a step of controlling the UV sterilizer 300 (in particular, in S900).

That is, as the UV sterilizer 300 does not continuously irradiate the UV light but periodically stops irradiating the UV light according to the predetermined duty ratio, the sterilization efficiency for mold and bacteria may be further improved.

In the control method of the laundry treatment apparatus 1000 according to an embodiment of the present disclosure, the step of controlling the UV sterilizer 300 may include a step of detecting a current operation mode of the laundry treatment apparatus 1000 (S500) and a step of operating the UV sterilizer 300 (S900) when the laundry treatment apparatus 1000 is switched to a predetermined operation mode (or to a predetermined state) (S600).

That is, the UV sterilizer 300 may be operated on the basis of whether the laundry treatment apparatus 1000 currently requires the sterilization process of the UV sterilizer 300. Accordingly, the sterilization process may be performed only when it is determined that the laundry treatment apparatus 1000 currently requires the sterilization process while the laundry treatment apparatus 1000 is operated.

In the control method of the laundry treatment apparatus 1000 according to an embodiment of the present disclosure, the step of controlling the UV sterilizer 300 may include a step of detecting a current state of the drum 30 through the sensor 700 (S500) and a step of operating the UV sterilizer 300 (S900) when the current state of the drum 30 detected by the sensor 700 reaches a predetermined state (S600).

That is, after it is determined, through the sensor 700, whether the laundry treatment apparatus 1000 currently requires the sterilization process, the sterilization process may be performed by the UV sterilizer 300.

In the control method of the laundry treatment apparatus 1000 according to an embodiment of the present disclosure, the step of controlling the UV sterilizer 300 may include a step of operating the UV sterilizer 300 (S900) when a predetermined time period has passed after a time point at which the laundry treatment apparatus 1000 was switched to the standby mode (S700).

That is, even when the laundry treatment apparatus 1000 is not used for a relatively long period of time, the laundry treatment apparatus 1000 may be set in such a way that the sterilization process is automatically performed for the heat exchanger 200 when a predetermined time period has passed.

In the control method of the laundry treatment apparatus 1000 according to an embodiment of the present disclosure, the step of controlling the UV sterilizer 300 may include a step of operating the UV sterilizer 300 (S900) when an operation signal is inputted by a user (S800).

That is, a user who wants to directly manipulate the laundry treatment apparatus 1000 to perform the sterilization process may input a signal to the input interface 800 for operating the UV sterilizer 300.

While specific exemplary embodiments of the present disclosure are described and illustrated above, it would be obvious to those skilled in the art that various modifications and variations can be made thereto within the spirit and scope of the present disclosure. Accordingly, such modifications or variations are not to be regarded as a departure from the spirit or scope of the present disclosure, and it is intended that the present disclosure cover the modifications and variations of the present disclosure provided they come within the scope of the appended claims and their equivalents.

What is claimed is:

1. A laundry treatment apparatus comprising:

a cabinet;

a drum rotatably disposed within the cabinet;

a suction duct to which air discharged from the drum flows;

a circulation flow path connected to the suction duct and configured to guide the air from the suction duct;

an inflow duct connecting the circulation flow path to the drum such that the air received from the circulation flow path flows back to the drum through the inflow duct;

a circulation fan configured guide the air between the suction duct and the inflow duct;

a heat exchanger that is disposed at the circulation flow path and that is configured to perform heat exchange with the air; and an ultraviolet (UV) sterilizer disposed at a space that is defined in the circulation flow path at a position above a front surface of the heat exchanger, the sterilizer being configured to irradiate UV light to the heat exchanger.

2. The laundry treatment apparatus of claim 1, wherein the heat exchanger comprises:

an evaporator configured to remove moisture from the air passing through the circulation flow path; and a condenser configured to heat air that has passed through the evaporator, wherein the UV sterilizer is configured to irradiate the UV light to a front surface of the evaporator.

3. The laundry treatment apparatus of claim 2, wherein the UV sterilizer comprises an LED module configured to irradiate the UV light by using electric energy.

4. The laundry treatment apparatus of claim 3, further comprising a cover frame that covers an upper surface of the circulation flow path and that recesses upward from an upper portion of the front surface of the evaporator, wherein the UV sterilizer is disposed at a recessed portion of the cover frame.

5. The laundry treatment apparatus of claim 4, further comprising a cleaning part configured to clean the front surface of the evaporator.

6. The laundry treatment apparatus of claim 5, wherein:

the cover frame comprises a first inclined surface and a second inclined surface that are coupled to each other and that define a shape recessed upward, the UV sterilizer is disposed at the first inclined surface, and the cleaning part is configured to spray cleaning water onto the second inclined surface such that the cleaning water runs down to the front surface of the evaporator along the second inclined surface.

7. The laundry treatment apparatus of claim 1, further comprising a controller configured to control an operation of the UV sterilizer, wherein the controller is configured to start or stop the operation of the UV sterilizer according to a predetermined duty ratio.

8. The laundry treatment apparatus of claim 7, wherein the controller is configured to, based on an operation mode of the laundry treatment apparatus being switched to a predetermined operation mode, operate the UV sterilizer.

9. The laundry treatment apparatus of claim 7, further comprising a sensor configured to detect a current state of the drum, wherein the controller is configured to, based on the detected current state of the drum, operate the UV sterilizer.

10. The laundry treatment apparatus of claim 9, wherein:

the sensor comprises an electrode sensor disposed at the drum, and the controller is configured to, based on a water content percentage in the drum estimated from a measured value detected by the electrode sensor reaching a predetermined value, operate the UV sterilizer.

11. The laundry treatment apparatus of claim 7, wherein the controller is configured to, based on a predetermined time period being passed after an operation mode of the laundry treatment apparatus was switched to a standby mode, operate the UV sterilizer.

12. The laundry treatment apparatus of claim 7, further comprising an input interface configured to receive an operation signal from a user, wherein the controller is configured to, based on the operation signal being received by the input interface, operate the UV sterilizer.

13. A control method of a laundry treatment apparatus that includes a drum, a suction duct, a circulation flow path, an inflow duct, a circulation fan, a heat exchanger, and a UV sterilizer, the control method comprising:

switching a current operation mode of the laundry treatment apparatus from a standby mode to an operation mode;

circulating air in the laundry treatment apparatus such that air in the circulation flow path is guided, after air discharged from the drum flows to the suction duct, to flow back to the drum through the inflow duct;

performing exchanging heat with the circulated air through the heat exchanger disposed at the circulation flow path; and controlling the UV sterilizer such that the UV sterilizer disposed at an upper portion of a front surface of the heat exchanger irradiates UV light to the heat exchanger.

14. The control method of the laundry treatment apparatus of claim 13, wherein controlling the UV sterilizer further comprises periodically starting and stopping an operation of the UV sterilizer according to a predetermined duty ratio.

15. The control method of the laundry treatment apparatus of claim 14, wherein controlling the UV sterilizer further comprises:

detecting the current operation mode of the laundry treatment apparatus; and operating the UV sterilizer based on the current operation mode the laundry treatment apparatus being switched to a predetermined operation mode.

16. The control method of the laundry treatment apparatus of claim 14, wherein controlling the UV sterilizer further comprises:

detecting a current state of the drum through a sensor; and operating the UV sterilizer based on the current state of the drum detected by the sensor reaching a predetermined state.

17. The control method of the laundry treatment apparatus of claim 14, wherein controlling the UV sterilizer further comprises operating the UV sterilizer based on a predetermined time period being passed after the current operation mode of the laundry treatment apparatus was switched to the standby mode.

18. The control method of the laundry treatment apparatus of claim 14, wherein controlling the UV sterilizer further comprises operating the UV sterilizer based on an operation signal being received from a user.

19. The control method of the laundry treatment apparatus of claim 13, further comprising:

removing moisture from the air passing through the circulation flow path by an evaporator; and controlling the UV sterilizer to irradiate the UV light to a front surface of the evaporator.

20. The control method of the laundry treatment apparatus of claim 19, further comprising cleaning a front surface of the evaporator.

* * * * *